US005988754A

United States Patent [19]

Lamart et al.

[11] Patent Number: 5,988,754

[45] Date of Patent: Nov. 23, 1999

[54] STOOL WITH FOOT SUPPORT

[75] Inventors: Michel A. Lamart, Sarrebourg, France; John Hanna J. Hasbany, Grand Rapids, Mich.; William M. Van Luyn, Wyoming, Mich.; Mark A. McCaul, Rochester Hills, Mich.

[73] Assignee: Steelcase Development Inc., Grand Rapids, Mich.

[21] Appl. No.: 09/248,488

[22] Filed: Feb. 10, 1999

[51] Int. Cl.[6] ..... A47C 7/50

[52] U.S. Cl. ..... 297/423.38; 297/344.19; 297/423.19; 248/161

[58] Field of Search ..... 297/423.38, 344.16, 297/344.19, 423.25, 423.4; 248/161

[56] References Cited

U.S. PATENT DOCUMENTS

| | | | |
|---|---|---|---|
| 2,308,358 | 1/1943 | Cramer . | |
| 2,659,413 | 11/1953 | Cramer . | |
| 3,278,229 | 10/1966 | Bates . | |
| 3,642,320 | 2/1972 | Ward . | |
| 4,148,524 | 4/1979 | Guyton . | |
| 4,348,051 | 9/1982 | Boucher . | |
| 4,408,801 | 10/1983 | Edel et al. . | |
| 4,960,305 | 10/1990 | Opsvik | 297/423.38 |
| 5,011,227 | 4/1991 | van Hekken et al. . | |

*Primary Examiner*—Anthony D. Barfield
*Attorney, Agent, or Firm*—Price Heneveld Cooper DeWitt & Litton

[57] ABSTRACT

A chair includes a base having a hub, radially extending legs connected to and supporting the hub, a vertically extendable gas spring rotatably supported on the hub, and a hub tube sleeve non-rotatably fixed to the hub. A seat includes a housing that engages and is supported on the gas spring for vertical height adjustment, and a sleeve retainer rotatably connected to the control housing and extending downwardly therefrom. The sleeve retainer non-rotatably but slidingly engages the hub tube sleeve. A footrest is supported by the sleeve retainer. The footrest is non-rotatably and slidably connected to the base via the sleeve retainer and the hub tube sleeve, so that the footrest moves vertically with the seat when the seat is vertically adjusted, but does not rotate with the seat when the seat is rotated. The footrest is adjustably supported on the sleeve retainer, so that it can be manually adjusted to change the distance from the footrest to the seat.

20 Claims, 6 Drawing Sheets

STOOL WITH FOOT SUPPORT

BACKGROUND OF THE INVENTION

The present invention concerns chairs with footrests, and more particularly concerns a chair having a vertically adjustable seat and having a footrest.

Chairs are often provided with footrests to comfortably support the feet of seated users, especially in chairs having rotatable seats positioned too high for a seated user to comfortably rest their feet on a floor. Such chairs are commonly used in bars, at kitchen counters, and at raised countertops where a seated person conducts business with a standing person. Seated users using these chairs like the footrest to be at a selected distance from the seat, so that their feet are comfortably supported and so that they can push off of the footrests to rotate the seat. Unfortunately, when a seat is vertically adjusted, the distance from the seat to the footrest changes. Thus, the footrest must also be made adjustable. However, making both the seat and the footrest adjustable can be very expensive, and further many customers do not want to have to separately adjust a footrest after a seat is adjusted. Another problem occurs when gas springs are used to assist in vertical adjustment of a chair seat, since the presence of the gas spring affects the structure of the hub and a vertical portion of the chair base. Specifically, the gas spring takes up space and makes it very difficult to support the footrest for vertical movement without creating a massive structure that is aesthetically unacceptable and also costly to manufacture. Notably, considerable torsional pressure can be applied to the footrest by a seated user when the seated user pushes off of the footrest due to the distance from the footrest to the hub. As a result, the footrest and chair base must be strongly and durably built, so that it can withstand considerable stress without unacceptably wearing and/or deforming. However, the footrest and its supporting structure must also not be too heavy, or the chair becomes expensive, difficult to move, and unacceptable to users. Also, the problem of a separate second adjustment of the footrest after the seat is adjusted must preferably be resolved.

Accordingly, a chair having a footrest solving the aforementioned problems and having the aforementioned advantages is desired.

SUMMARY OF THE PRESENT INVENTION

In one aspect of the present invention, a chair includes a base having a vertically extendable gas spring and a seat operably supported on the gas spring for vertical height adjustment. A foot support is supported by the seat for vertical movement with the seat when the seat is vertically adjusted. However, the foot support is non-rotatably and slidably connected to the base and rotatably connected to the seat, so that the footrest moves vertically with the seat when the seat is vertically adjusted, but does not rotate with the seat when the seat is rotated.

In another aspect of the present invention, a chair includes a base having a non-rotatable hub. A seat is operably supported on the base for vertical height adjustment of the seat relative to the base and for rotation of the seat relative to the base. The seat includes a housing, and a foot support is provided that includes a sleeve retainer supported by the housing. The sleeve retainer extends downwardly from the seat and supports a footrest. The sleeve retainer non-rotatingly but vertically slidably engages the hub. By this arrangement, the footrest maintains a constant position with respect to the base and does not rotate when the seat is rotated, but moves vertically with the seat when the seat is vertically adjusted.

In another aspect of the present invention, a chair includes a base having a hub, radially extending legs connected to and supporting the hub, a vertically extendable spring rotatably supported on the hub, and a hub tube sleeve non-rotatably supported on the hub. A seat includes a housing that non-rotatably engages and is supported on the spring for vertical height adjustment and a sleeve retainer rotatably connected to the control housing and extending downwardly therefrom. The sleeve retainer non-rotatably engages the hub tube sleeve but slidingly engages the hub tube sleeve for vertical sliding movement. A foot support is supported by the sleeve retainer for vertical movement with the seat when the seat is vertically adjusted. The footrest is non-rotatably and slidably connected to the base via the sleeve retainer and the hub tube sleeve, so that the footrest moves vertically with the seat when the seat is vertically adjusted, but so that the footrest does not rotate with the seat when the seat is rotated.

These and other features, objects, and advantages of the present invention will become apparent to a person of ordinary skill upon reading the following description and claims together with reference to the accompanying drawings.

DETAILED DESCRIPTION OF THE PREFERRED EMBODIMENT

Figure 1:
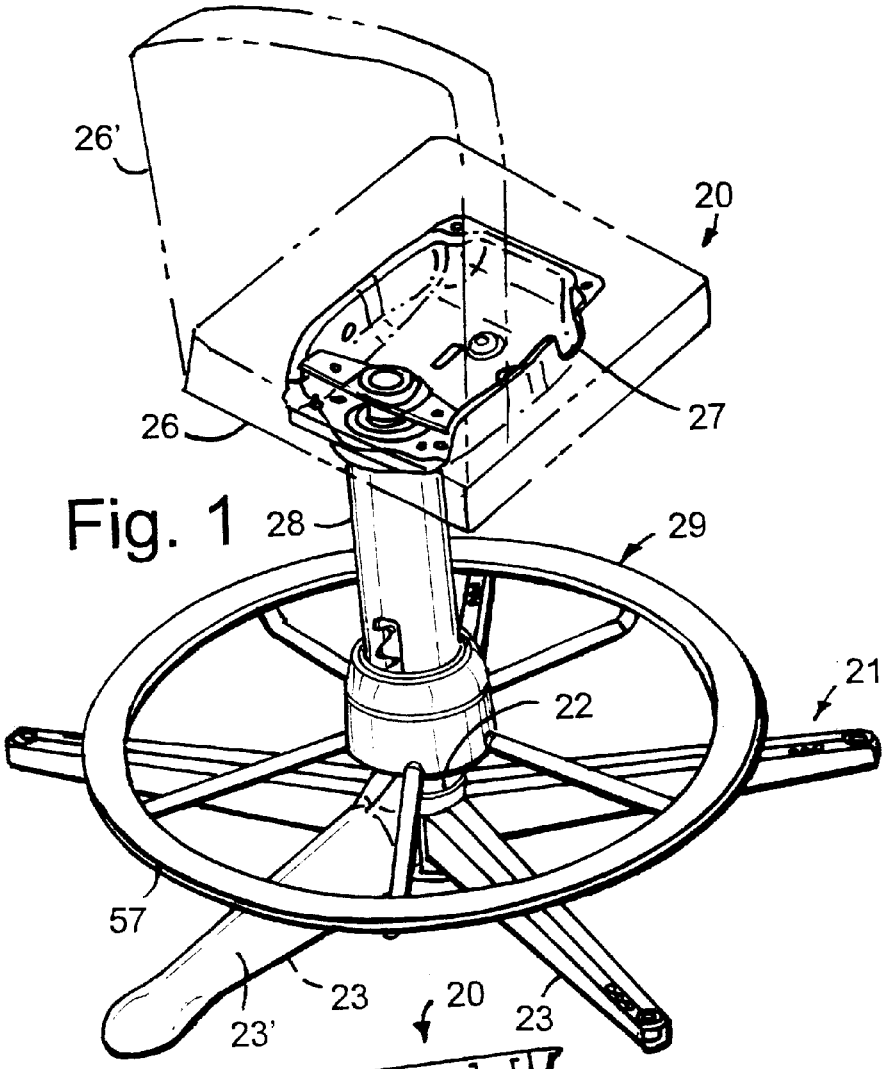
FIG. 1 is a perspective view of a chair embodying the present invention, the chair including a footrest.
Figure 2:
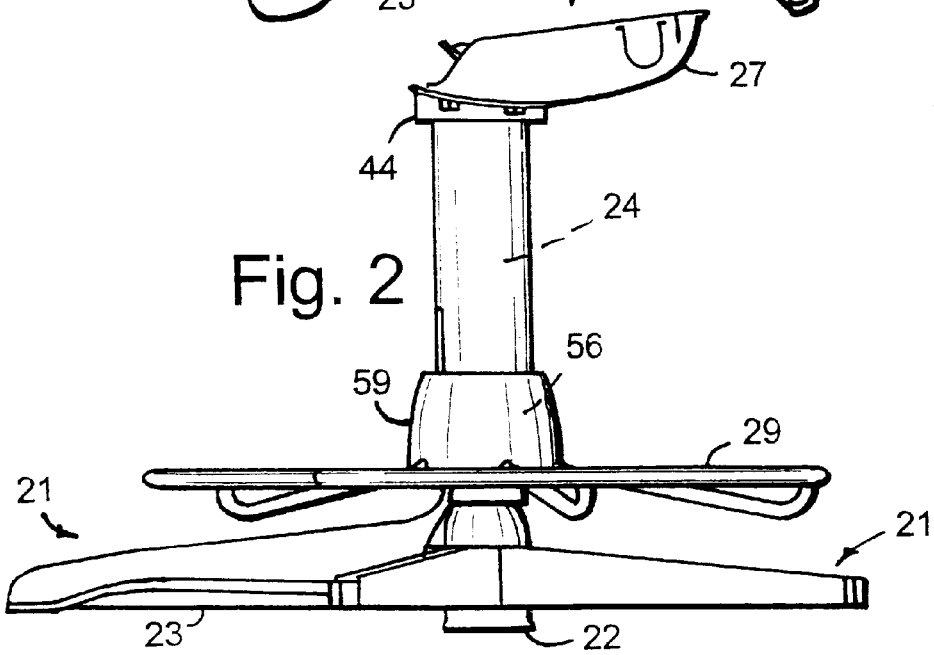
FIGS. 2 and 3 are side and top views of the chair shown in FIG. 1.
Figure 3:
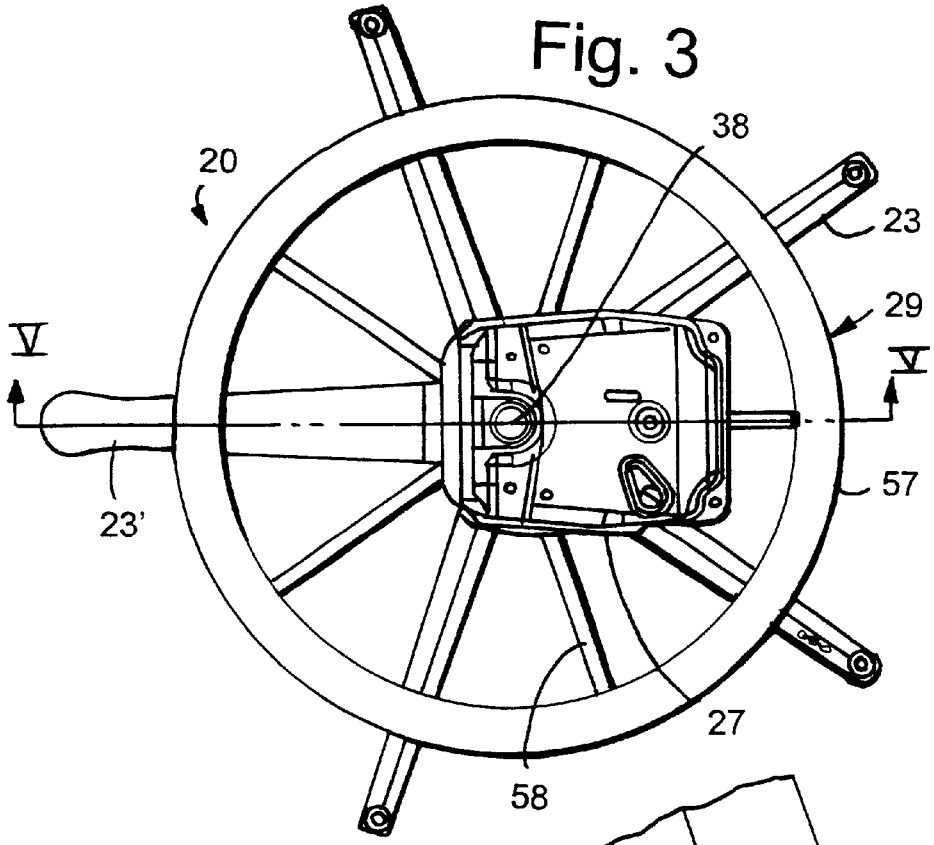
Figure 4:
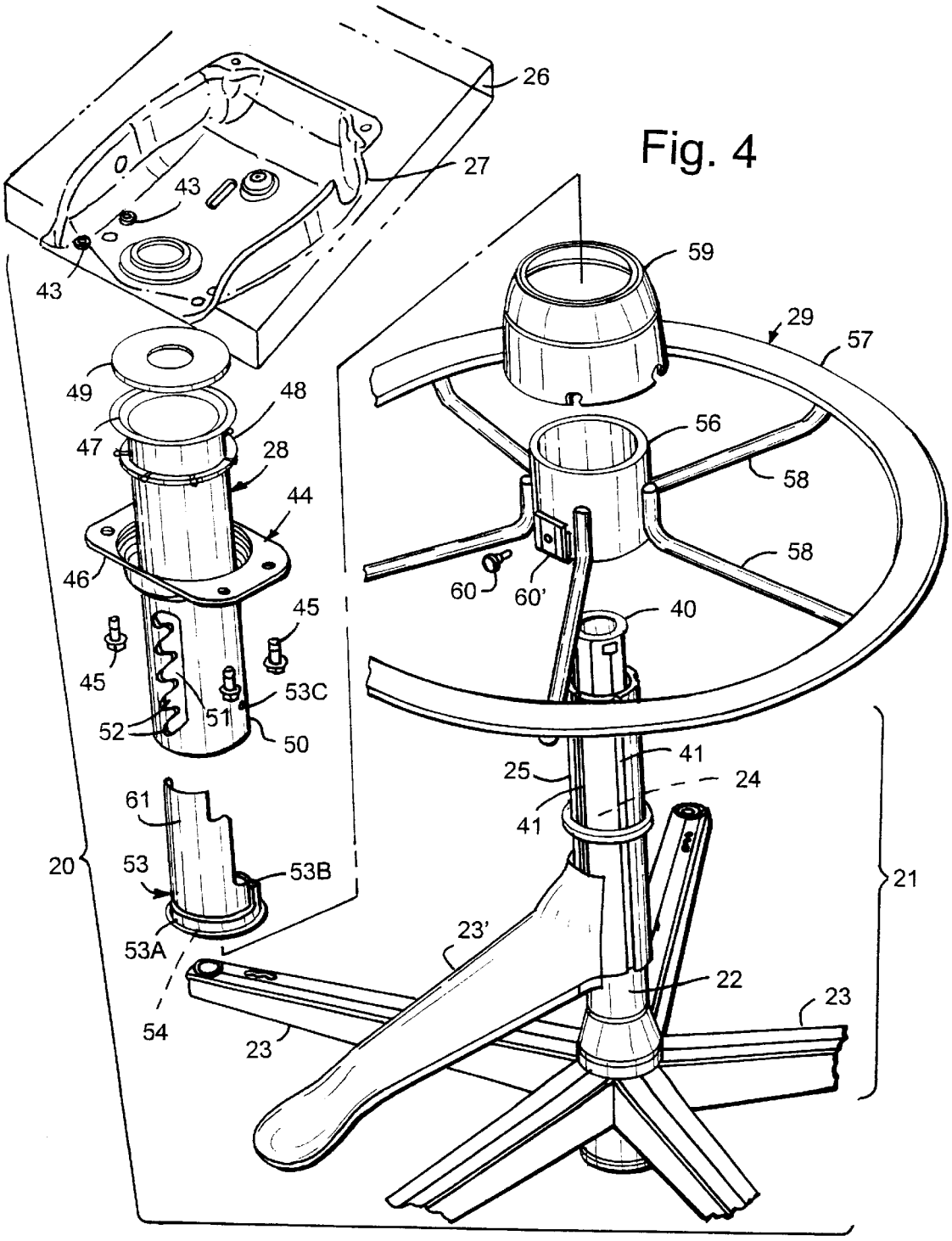
FIG. 4 is an exploded perspective view of the chair shown in FIG. 1.
Figure 5:
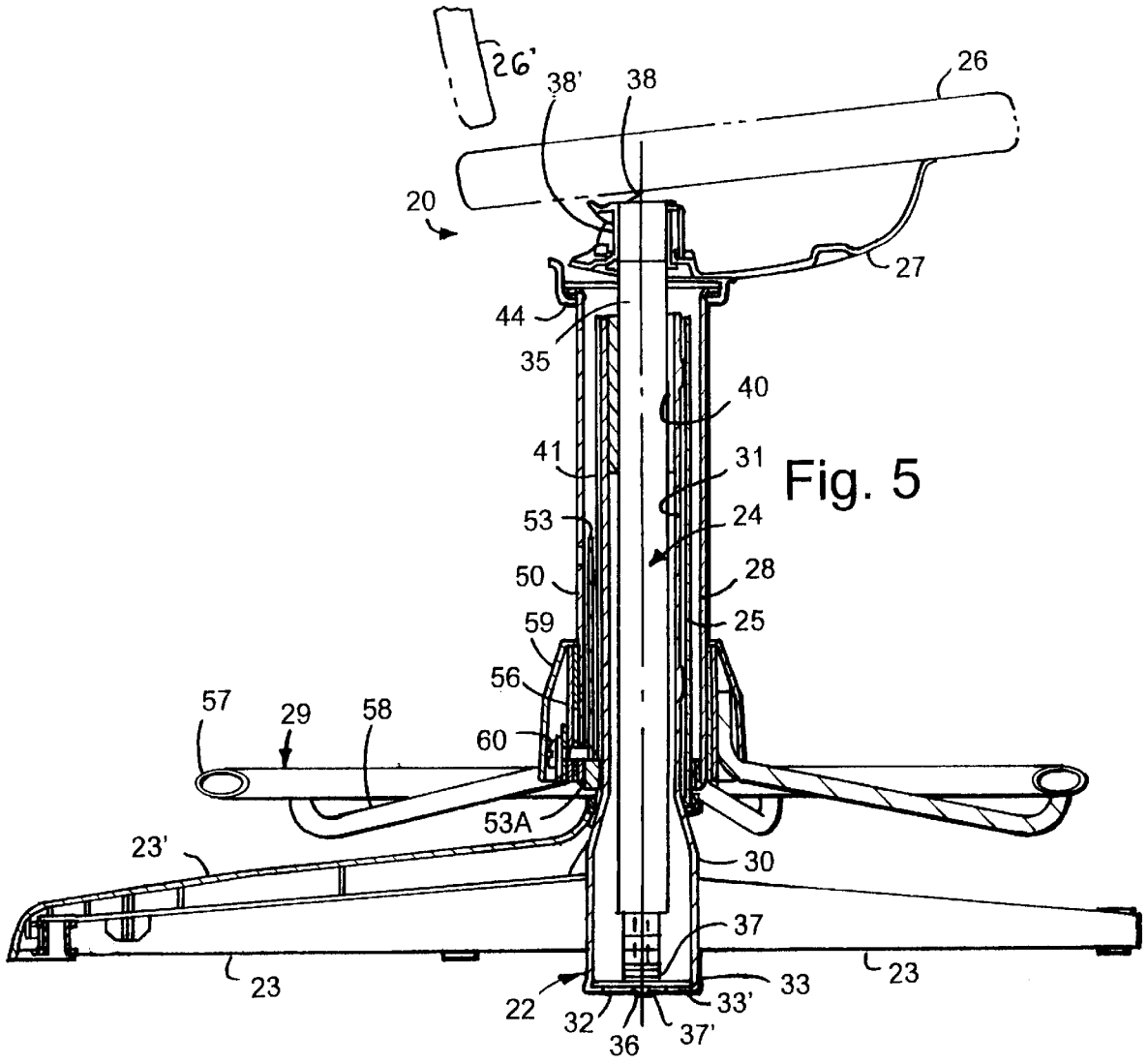
FIG. 5 is a cross-sectional view taken along line V—V in FIG. 3.
Figure 6:
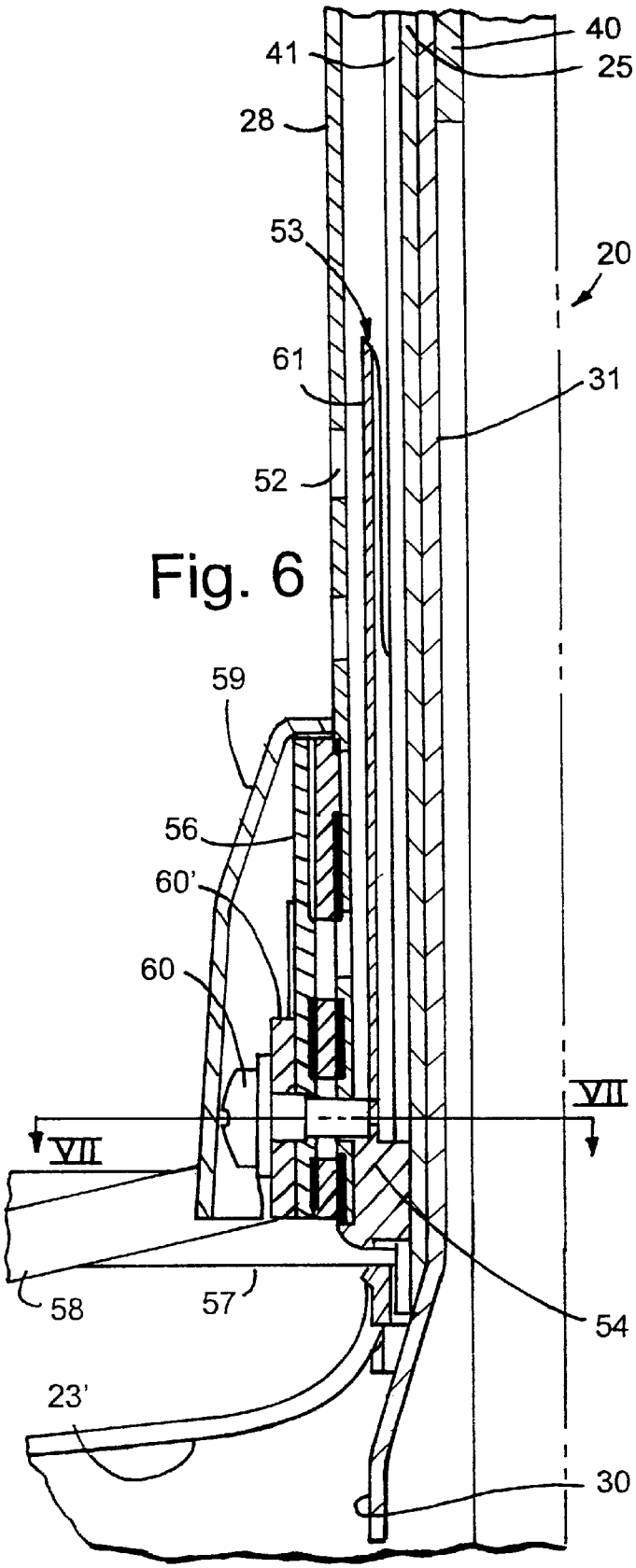
FIG. 6 is an enlarged view of a lower section of FIG. 5.

A chair 20 (FIG. 1) includes a base 21 having a vertically elongated center tube or hub 22 (FIG. 4), radially extending legs 23 welded to and supporting the hub 22, a vertically extendable pneumatic gas spring 24 (FIG. 5) rotatably supported inside the hub 22, and a hub tube outer sleeve 25 non-rotatably fixed to and engaging the hub 22. A seat 26 includes a control housing 27 supported on the gas spring 24 for vertical height adjustment. A foot support (FIG. 4) includes a sleeve retainer 28 rotatively supported under the control housing 27 and a footrest 29 supported by the sleeve retainer 28. The sleeve retainer 28 rotatably engages the control housing 27 but non-rotatably engages the hub tube sleeve 25. This arrangement lets the seat 26 rotate while the footrest 29 does not, yet also lets the footrest 29 move vertically with the seat 26 when the seat 26 is vertically adjusted. Notably, the footrest 29 is manually separately adjustable on the sleeve retainer 28, so that the distance between the footrest 29 and the seat 26 can be manually separately adjusted if desired.

The hub 22 of base 21 (FIG. 5) is a steel tube formed to include an enlarged, cylindrically shaped lower section 30 and a vertically elongated, cylindrically shaped upper section 31. The radially extending legs 23 are welded to an exterior surface of the lower section 30 and are covered by leg covers 23'. An annular hollowed out area defined by a ridge 33 is formed at a bottom end of the lower section 30 for receiving a washer-like plate 32. During manufacture of the base 21, the washer-like plate 32 is inserted against the ridge 33 inside the lower section 30, and a bottom ring is formed inwardly to form a retainer lip 33' to securely capture the washer-like plate 32. This construction rigidifies the hub 22.

The gas spring 24 (FIG. 5) includes a cylinder 35 and an extendable rod 36 operably connected to a piston within the cylinder 35. An end of the rod 36 includes a roller bearing 37 and includes grooves for receiving a retainer clip 37'. The rod 36 is attached to the hub 22 by extending the rod 36 through a centered hole in the washer-like plate 32 until the roller bearing 37 rests on the plate 32. Then the clip 37' is attached to secure the gas spring 24 to the plate 32. The cylinder 35 is generally cylindrically shaped, but its upper end section is tapered to mateably, press-fittingly engage a mating tapered hole in support structure 38' in the housing 27. When so engaged, a release button 38 extends upwardly from the gas spring 24 into the housing 27. A height adjustment actuator mechanism (not shown) is positioned in control housing 27 to selectively activate the release button 38 to provide vertical height adjustment of the seat 26. Such actuator mechanisms are well known in the art and need not be described herein to understand the present invention. A hub liner 40 is positioned in the upper section 31 for supporting the cylinder 35 in an axially centered position within the hub 22. The hub tube sleeve 25 is non-rotatably attached to an outside of the upper section 31 of the hub 22. Hub tube sleeve 25 is a lubricious polymer and includes a plurality of vertical channels or grooves 41 in its outer surface.

It is specifically contemplated that the back and seat can be a variety of different configurations and still be within the scope of the present invention. For example, the chair 20 can include a back 26' supported by an upright pivoted to sidewalls of the housing 27 and a seat 26 operably supported on the housing 27. These are not shown in detail since they are not required for an understanding of the present invention, and further many back and seat constructions are well known in the art.

Housing 27 (FIG. 4) includes threaded holes 43 located around the tapered hole in support structure 38'. A support bracket 44 is bolted to a bottom of the housing 27 with bolts 45 that engage holes 43. The support bracket 44 includes an annular flange 46 that opposes a top flange 47 on sleeve retainer 28. A rotational ball bearing 48 is positioned between top flange 47 and annular flange 46, so that the sleeve retainer 28 is rotatably supported on housing 27. By this arrangement, the sleeve retainer 28 is carried vertically when housing 27 (and seat 26) is vertically adjusted by extension of the gas spring 24. A lubricious washer 49 is located between the top flange 47 and the housing 27 to stabilize the sleeve retainer 28 and provide a tight assembly.

Figure 8:
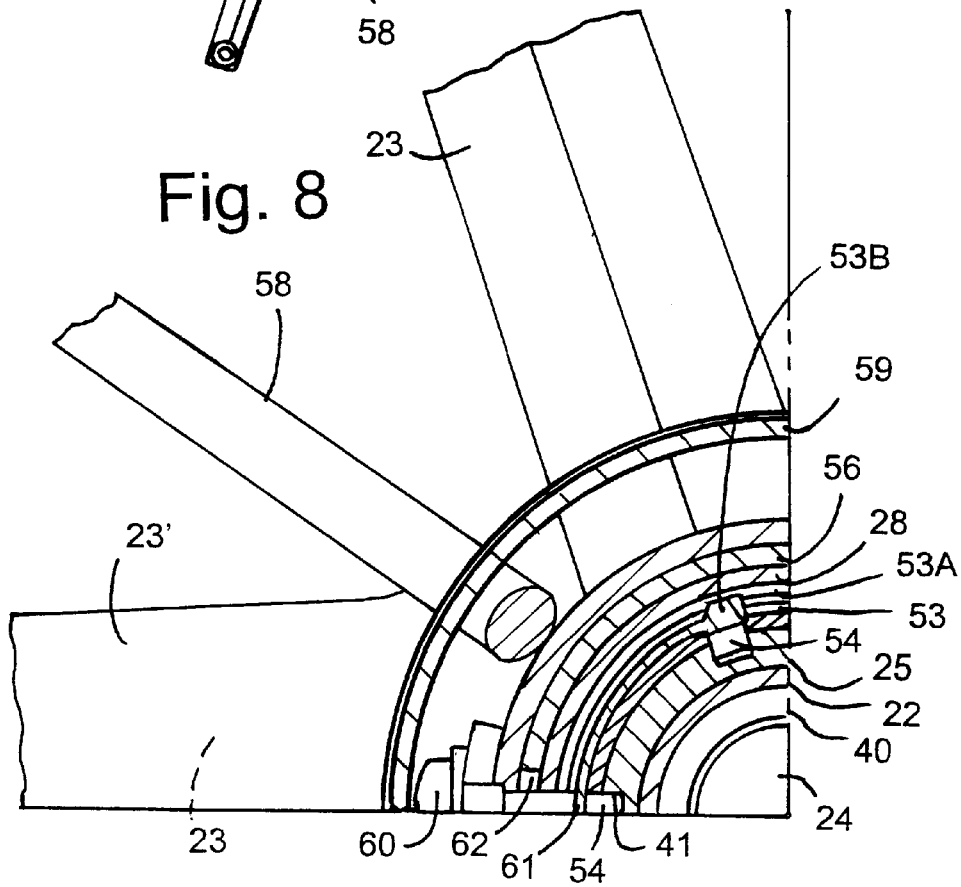
FIG. 8 is a duplicate of a quarter section of FIG. 7.
Figure 7:
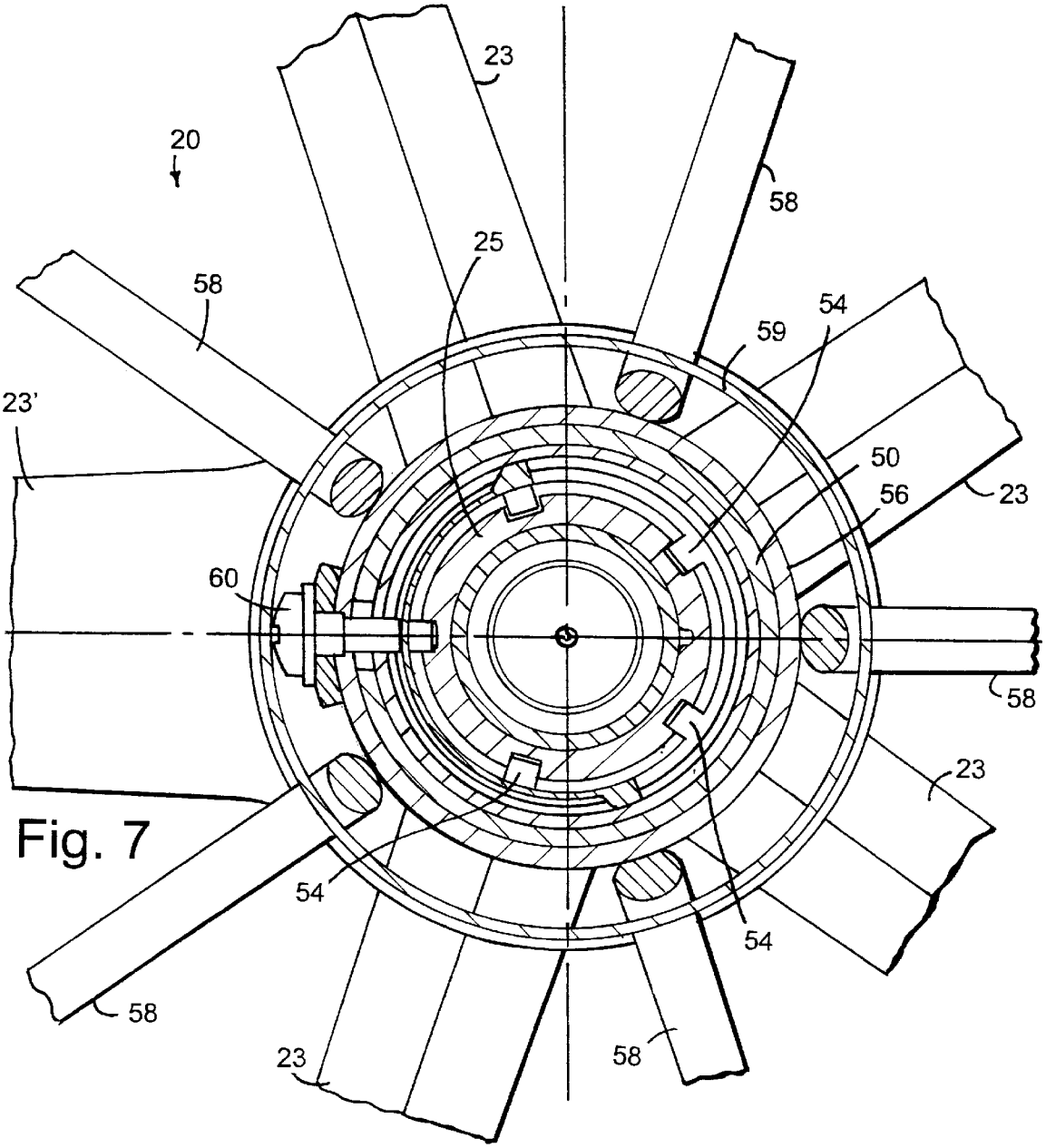
FIG. 7 is a horizontal cross section taken along the line VII—VII in FIG. 6.

Sleeve retainer 28 (FIG. 4) includes a lower half section 50 having a vertical slot 51 with down angled side notches 52. A bottom support ring 53 attaches inside the sleeve retainer 28 to center a bottom of the sleeve retainer 28. The bottom support ring 53 includes a full cylindrical ring section 53A that engages the hub tube sleeve 25. The full ring section 53A includes opposing protrusions 53B that snap into holes 53C in sleeve retainer 28. The bottom support ring 53 further includes a plurality of protrusions 54 (FIGS. 7 and 8) that extend inwardly into secure sliding engagement with the vertical grooves 41 on an outside of the hub tube sleeve 25. The protrusions 54 slidably, vertically engage the grooves 41, such that the sleeve retainer 28 remains in a fixed angular position relative to the base 21. At the same time, a weight of the sleeve retainer 28 and footrest 29 is carried by the housing 27, such that the sleeve retainer 28 (and footrest 29) moves vertically with the seat 26 (and control housing 27) when the seat 26 is vertically adjusted.

Footrest 29 (FIG. 4) includes a center sleeve 56, an outer tubular foot ring 57, and spokes 58 that extend between the center sleeve 56 and the outer foot ring 57. The foot ring 57 is configured to support a seated user's feet 360° around the seat 29, and the spokes 58 are structurally strong enough in size and number to support the foot ring 57 without unacceptable deformation or bending. It is contemplated that different footrests can be provided, such as ones that include only a partial ring or a step-shaped member. A cover 59 drapes over and covers the center sleeve 56 for aesthetics. The center sleeve 56 is adjustably secured to a bottom of the sleeve retainer 28 by a stud or bolt 60 that threads into nut 60'. The center sleeve 56 is adapted to slide vertically on the sleeve retainer 28, and the stud 60 is adapted to slide vertically in the vertical slot 51 and can be manipulated selectively into one of side notches 52 to manually position the foot ring 57 at a selected vertical distance from the seat 26. An upper arcuate section 61 of bottom support ring 53 is located behind the vertical slot 51 and side notches 52 and acts as a shield, such that it prevents the inner end of stud 60 from engaging one of the grooves 41.

In operation, the seat 26 is vertically adjusted by manipulating a vertical adjustment mechanism that operates the release button 38, thus releasing the cylinder 35 for extension on rod 36. The pressure within gas spring 24 is sufficient to lift the seat 26 and footrest 29 against the weight of the seat 26, although a person can of course overcome the force of the gas spring 24 to lower the seat 26 if desired. When the seat is vertically adjusted, the footrest 29 moves with the seat 26, maintaining the spacing between the foot ring 57 and the seat 26. If the spacing between the foot ring 57 and the seat 56 is not optimal for a given user, the footrest 29 can be separately adjusted by manually rotating the footrest 29 relative to the base 21, so that the stud 60 disengages from a particular one of the side notches 52. Thereafter, the footrest 29 can be vertically adjusted, so that the stud 60 slides within the vertical slot 51, and then locked at a newly selected spacing by moving the stud 60 into a newly selected side notch 52. When a seated user is sitting on the seat 26, the seated user can cause the seat 26 to rotate by pushing off of the foot ring 57. When this occurs, the foot ring 57 remains in a stationary angular position relative to the base 21, but permits the seat 26 to rotate even though a weight of the footrest 29 is supported by the seat 26.

In the foregoing description, it will be readily appreciated by persons skilled in the art that modifications may be made to the invention without departing from the concepts disclosed herein. Such modifications are to be considered as included in the following claims, unless these claims by their language expressly state otherwise.

The invention claimed is:

1. A chair comprising:

a base including a vertically extendable gas spring;

a seat operably supported on the gas spring for vertical height adjustment; and a foot support supported by the seat for vertical movement with the seat when the seat is vertically adjusted, the foot support being non-rotatably and slidably connected to the base and rotatably connected to the seat, so that the foot support moves vertically with the seat when the seat is vertically adjusted, but does not rotate with the seat when the seat is rotated.

2. The chair defined in claim 1, wherein the seat includes a housing, and wherein the foot support includes a footrest and a sleeve retainer that extends from the housing to support the footrest, the sleeve retainer rotatably engaging the housing and operably supporting the footrest.

3. The chair defined in claim 2, wherein the base includes a hub, the gas spring rotatably engaging the hub.

4. The chair defined in claim 3, wherein the base includes a non-rotatable hub tube sleeve that slidingly but non-rotatably engages the sleeve retainer.

5. The chair defined in claim 4, wherein the hub tube sleeve includes a vertical channel and the sleeve retainer includes a protrusion slidably engaging the channel.

6. The chair defined in claim 5, wherein the base includes a hub liner that supports the gas spring to maintain a vertical orientation of the gas spring.

7. The chair defined in claim 6, wherein the footrest extends 360 degrees around the base.

8. The chair defined in claim 6, wherein the footrest vertically, adjustably engages the sleeve retainer.

9. The chair defined in claim 1, wherein the base includes a hub, the gas spring rotatably engaging the hub.

10. The chair defined in claim 1, wherein the base includes a non-rotatable hub tube sleeve and the foot support slidingly but non-rotatably engages the hub tube sleeve for telescoping vertical movement.

11. The chair defined in claim 10, wherein the hub tube sleeve includes a vertical channel and the foot support includes a key slidably engaging the channel.

12. The chair defined in claim 1, wherein the base includes a hub liner that supports the gas spring in a vertical orientation.

13. The chair defined in claim 1, wherein the footrest extends 360 degrees around the base.

14. The chair defined in claim 1, wherein the base includes a tubular hub and the foot support includes a footrest, a sleeve retainer rotatably connects to the seat for supporting a weight of the footrest, and a support ring secures to an inside of the retainer ring, the retainer ring and the tubular hub including mating grooves and protrusions that prevent rotation, but that permit vertical sliding movement of the support ring on the tubular hub.

15. A chair comprising:

a base including a non-rotatable hub;

an elevating device supported on the hub;

a seat operably and rotatably supported on the elevating device for vertical height adjustment of the seat relative to the base and for rotation of the seat relative to the base, the seat including a housing; and a foot support, the foot support including a sleeve retainer rotatably supported by the housing and extending downwardly from the seat, the sleeve retainer non-rotatingly but vertically, slidably engaging the hub and including a footrest supported by the sleeve retainer, whereby the footrest maintains a constant position with respect to the base and does not rotate when the seat is rotated, but moves vertically with the seat when the seat is vertically adjusted.

16. The chair defined in claim 15, wherein the sleeve retainer rotatably engages the housing.

17. The chair defined in claim 16, wherein the hub includes a hub tube sleeve and a vertical channel, and the sleeve retainer includes a key slidably engaging the vertical channel.

18. The chair defined in claim 15, wherein the sleeve is provided a manual adjustment mechanism that adjustably attaches the footrest on the sleeve, thereby allowing for manual adjustment of the distance between the footrest and the seat.

19. A chair comprising:

a base including a hub, radially extending legs connected to and supporting the hub, a vertically extendable spring rotatably supported on the hub, and a hub tube sleeve non-rotatably supported on the hub;

a seat including a housing that non-rotatably engages and is supported on the spring for vertical height adjustment, and a sleeve retainer rotatably connected to the control housing and extending downwardly therefrom, the sleeve retainer non-rotatably engaging the hub tube sleeve but slidingly engaging the hub tube sleeve for vertical sliding movement; and a foot support supported by the sleeve retainer for vertical movement with the seat when the seat is vertically adjusted, the footrest being non-rotatably and slidably connected to the base via the sleeve retainer and the hub tube sleeve, so that the footrest moves vertically with the seat when the seat is vertically adjusted, but so that the footrest does not rotate with the seat when the seat is rotated.

20. The chair defined in claim 19, wherein one of the sleeve retainer and the hub tube sleeve includes a channel and the other of the sleeve retainer and the hub tube sleeve includes a protrusion the slidably engages the channel during height adjustment of the seat.

* * * * *